US009640883B2

(12) United States Patent
Tatzel et al.

(10) Patent No.: US 9,640,883 B2
(45) Date of Patent: May 2, 2017

(54) CONNECTING MEMBER

(71) Applicant: ROSENBERGER HOCHFREQUENZTECHNIK GMBH & CO. KG, Fridolfing (DE)

(72) Inventors: Frank Tatzel, Ostermiething (AT); Tobias Oberhauser, Feichten (DE); Hauke Schütt, Bünsdorf (DE)

(73) Assignee: Rosenberger Hochfrequenztechnik GmbH and Co., KG, Fridolfing (DE)

( * ) Notice: Subject to any disclaimer, the term of this patent is extended or adjusted under 35 U.S.C. 154(b) by 0 days.

(21) Appl. No.: 14/373,118

(22) PCT Filed: Dec. 11, 2012

(86) PCT No.: PCT/EP2012/005113
§ 371 (c)(1),
(2) Date: Jul. 18, 2014

(87) PCT Pub. No.: WO2013/107484
PCT Pub. Date: Jul. 25, 2013

(65) Prior Publication Data

US 2014/0357099 A1 Dec. 4, 2014

(30) Foreign Application Priority Data

Jan. 19, 2012 (DE) ..... 20 2012 000 487 U

(51) Int. Cl.

| | |
|---|---|
| ***H01R 12/70*** | (2011.01) |
| ***H01R 12/91*** | (2011.01) |
| ***H01R 24/54*** | (2011.01) |
| ***H01R 12/71*** | (2011.01) |

(52) U.S. Cl.
CPC ..... *H01R 12/7082* (2013.01); *H01R 12/91* (2013.01); *H01R 12/714* (2013.01); *H01R 24/54* (2013.01)

(58) Field of Classification Search
CPC .. H01R 12/7082; H01R 12/91; H01R 12/714; H01R 24/54
USPC ..... 439/65, 63, 581–583
See application file for complete search history.

(56) References Cited

U.S. PATENT DOCUMENTS

| | | | | |
|---|---|---|---|---|
| 4,795,352 | A | 1/1989 | Capp | |
| 6,497,579 | B1 * | 12/2002 | Garbini | H01R 13/6315 439/246 |
| 6,776,668 | B1 | 8/2004 | Scyoc | |
| 6,881,082 | B2 * | 4/2005 | Jordan | H01R 13/7033 439/188 |
| 7,118,383 | B2 * | 10/2006 | Nagata et al. | 439/63 |

(Continued)

FOREIGN PATENT DOCUMENTS

| | | | |
|---|---|---|---|
| CN | 1728473 | A | 2/2006 |
| DE | 60204640 | T2 | 5/2006 |

(Continued)

*Primary Examiner* — James Harvey
*Assistant Examiner* — Oscar C Jimenez
(74) *Attorney, Agent, or Firm* — DeLio, Peterson & Curcio, LLC; Robert Curcio

(57) ABSTRACT

A connecting element for electrically conductively connecting two component parts to a conductor, the conductor having at least two conductor elements which are movable relative to one another in the connection direction, wherein a relative movement of the conductor elements results in a radial deformation of at least one of the conductor elements.

13 Claims, 2 Drawing Sheets

(56) References Cited

U.S. PATENT DOCUMENTS

| | | | | |
|---|---|---|---|---|
| 7,189,113 | B2 * | 3/2007 | Sattele | H01R 13/6277 439/253 |
| 7,416,418 | B2 * | 8/2008 | Berthet | H01R 24/50 439/63 |
| 7,717,716 | B2 * | 5/2010 | Dahms | H01R 12/52 439/248 |
| 8,298,007 | B2 * | 10/2012 | Taguchi | 439/578 |
| 9,065,186 | B2 * | 6/2015 | Perrin | H01R 9/0515 |
| 2003/0085716 | A1 | 5/2003 | Schiffer | |
| 2010/0159718 | A1 * | 6/2010 | Duquerroy | H01R 13/2414 439/66 |
| 2014/0030915 | A1 * | 1/2014 | Perrin | H01R 24/50 439/578 |
| 2014/0322970 | A1 * | 10/2014 | Binder | H01R 13/629 439/578 |

FOREIGN PATENT DOCUMENTS

| | | | |
|---|---|---|---|
| DE | 102005033915 | A1 | 2/2007 |
| DE | 602005000768 | T2 | 12/2007 |
| DE | 202011108052 | U1 | 1/2012 |
| JE | 1866771 | U | 2/1963 |
| JP | 2002198107 | A | 7/2002 |
| JP | 2006066384 | A | 3/2006 |
| WO | 2010010524 | A1 | 1/2010 |
| WO | 2011013747 | A1 | 2/2011 |
| WO | 20110013747 | A1 | 2/2011 |

* cited by examiner

CONNECTING MEMBER

BACKGROUND OF THE INVENTION

1. Field of the Invention

The invention relates to a connecting member for the electrically conductive connection of two components, and in particular to a connecting member by which radio-frequency signals can be transmitted between two components, and in particular two printed circuit boards, with the greatest possible freedom from losses.

2. Description of Related Art

In the case of connecting members of this kind, it is necessary to ensure that the radio-frequency signals are transmitted with the greatest possible freedom from losses even within a defined range of tolerances on the parallelism of the two printed circuit boards and on the distance between them. Further requirements to be met by such connecting members lie in the areas of inexpensive manufacture and easy assembly. Also, the axial and radial dimensions of the connecting member need to be kept as small as possible.

What are used at the moment are chiefly connecting members of this kind of two designs.

On the one hand, a connection is made between two printed circuit boards by means of two co-axial plug-in connectors which are solidly connected to the printed circuit boards and an adapter, the so-called "bullet", which connects the two co-axial plug-in connectors. This adapter allows axial and radial tolerances to be compensated for and also allows tolerances on parallelism to be compensated for. Typical co-axial plug-in connectors used for this purpose are SMP connectors, mini-SMP connectors and FMC connectors.

Alternatively, electric connections are also made between two printed circuit boards by means of spring-loaded contact pins, so-called Pogo pins, of single-conductor and/or multi-conductor construction. Spring-loaded contact pins of this kind comprise a sleeve and a head which is partly guided within the sleeve plus a coil spring which is supported between the head and the sleeve. The properties with respect to resilient force and solid height which the coil spring is required to have call for springs of relatively great length, which have a commensurate adverse effect on the overall axial height of the spring-loaded contact pins. The use of spring-loaded contact pins of single-conductor construction also has the disadvantage that they have to be laid out in a particular pattern to act as signal and ground pins if satisfactory electrical performance is to be achieved. Multi-conductors on the other hand are prone to faults and costly due to their complicated construction.

SUMMARY OF THE INVENTION

Taking the above prior art as a point of departure, the object underlying the invention was to specify an improved connecting member for the electrical connection of two components. In particular, although having properties which compensated for tolerances, the connecting member was to be distinguished by inexpensive manufacture, construction which was simple and hence not at risk of errors, and/or easy assembly.

This object is achieved by virtue of the subject matter of the claims. Advantageous embodiments of the connecting member according to the invention can be seen from the description of the invention which follows.

The above and other objects, which will be apparent to those skilled in the art, are achieved in the present invention which is directed to a connecting member for the electrically conductive connection of two components, including a conductor, the conductor comprising at least two conductor parts which are movable relative to one another in the direction of connection, a relative movement only being possible by the application of external forces when the two conductor parts are in a neutral position, such that the relative movement of the conductor parts results in a radial elastic deformation of at least one of the conductor parts, a sliding together of the conductor parts being possible in the neutral position by the exertion of a low thrust force to compensate for tolerances on the positions of the two components to be connected, and in that the conductor parts form a stop, which limits a relative movement due to the radial elastic deformation, it thus only being possible for the conductor parts to be pulled apart in the neutral position by the application of considerable force.

At least one of the conductor parts includes a narrowing portion. At least a first one of the conductor parts comprises a plurality of resilient tongues which bear against a surface of a second conductor part. The first conductor part may be produced by bending round a blank cut to shape into a tube. The conductor may surround a center conductor as an outer conductor.

A free end of the first conductor part may be connected to an annular adapter member which creates at one axial end of the connecting member a contact-making surface to make contact with a first component, and a free end of the second conductor part creates at the other axial end of the connecting member a contact-making surface to make contact with a second component. The annular adapter member is preferably of an L-shaped form in cross-section.

The center conductor may be in the form of a spring-loaded contact pin.

The connecting member may include an insulating member arranged between the outer conductor and the center conductor. The insulating member is preferably solidly connected to the center conductor and to at least a portion of one of the conductor parts.

BRIEF DESCRIPTION OF THE DRAWINGS

The features of the invention believed to be novel and the elements characteristic of the invention are set forth with particularity in the appended claims. The figures are for illustration purposes only and are not drawn to scale. The invention itself, however, both as to organization and method of operation, may best be understood by reference to the detailed description which follows taken in conjunction with the accompanying drawings in which:

DESCRIPTION OF THE PREFERRED EMBODIMENT(S)

Figure 1:
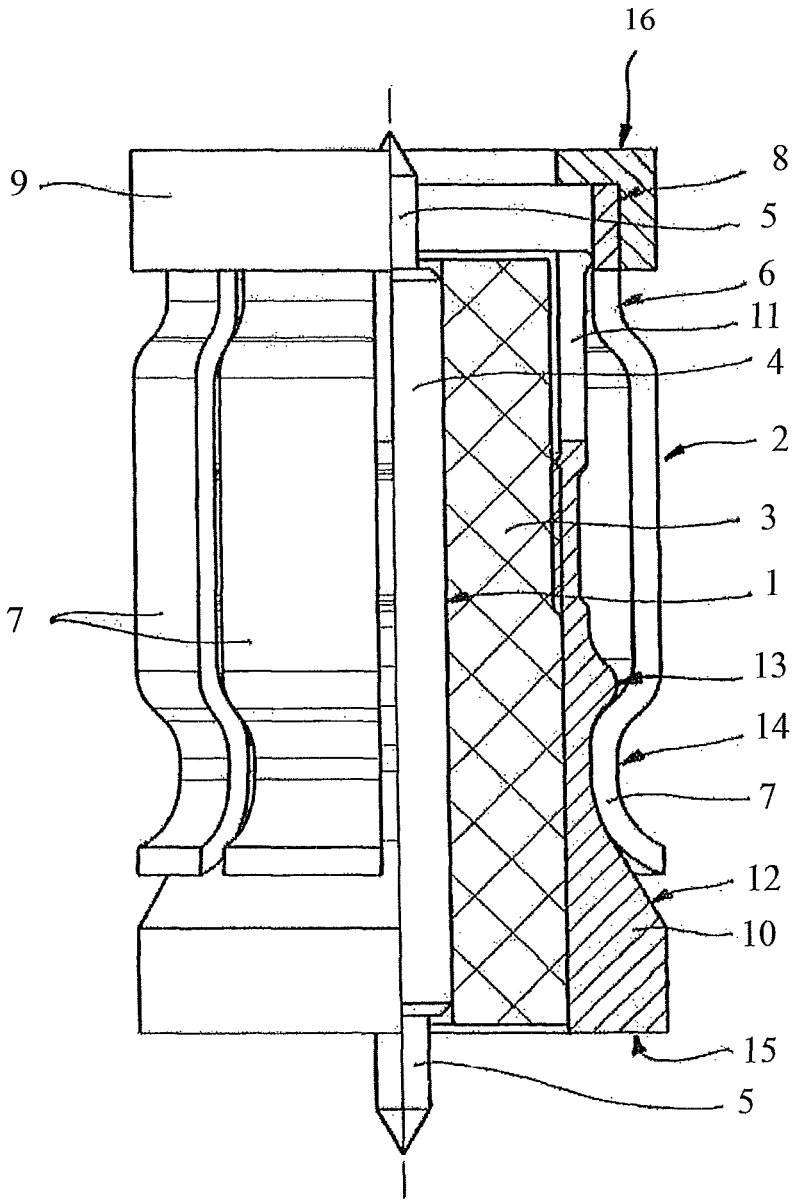
FIG. 1 is a view from the side, partly in section, of a connecting member according to the invention.

In describing the preferred embodiment of the present invention, reference will be made herein to FIGS. 1-5 of the drawings in which like numerals refer to like features of the invention.

The idea underlying the invention is to make the electrical connection between two components by means of a conductor of the simplest possible construction, and to bring about a compensation for tolerances on the positions of the two components to be connected by a deformation of this conductor due to its structural design.

What is used for this purpose in accordance with the invention is a conductor which comprises at least two parts which are movable relative to one another in the direction of connection, with a relative movement of the conductor parts resulting in a radial, and preferably elastic, deformation of at least one of the conductor parts.

The two conductor parts may thus be of a telescopic form and tolerances on the positions of the components to be connected, and in particular on the distance from one another of (the points of connection of) the components, may be compensated for by a telescopic sliding together and apart. The radial deformation of at least one of the conductor parts which is produced by the relative movement of the two conductor parts ensures that the sliding together in particular takes place only sufficiently far as is needed to compensate for the tolerances on position. What is thereby achieved is that the conductor makes secure contact at the points of connection of the two components.

What is meant by the "direction of connection" is the direction which is defined by a straight connecting line between the two points of connection of the components.

A preferred possible way of producing the radial deformation caused by the relative movement may make, provision for at least one portion of at least one of the conductor parts to take a narrowing (e.g. conical) form. A corresponding mating portion of another conductor part may then slide on the narrowing portion in the course of the relative movement and may thus be expanded radially.

At least that portion of the other conductor part which slides on the narrowing portion should preferably be so designed that it generates sufficiently low restoring forces to perform the function envisaged in accordance with the invention of compensating for tolerances under the forces which are applied or can be transmitted when the two components and the connecting member are fitted together. For this purpose, provision may preferably be made for at least a first one of the conductor parts, and as a particular preference that one whose portion slides on the narrowing portion of the other conductor part, to form a plurality of resilient tongues which bear against a surface (of, as a particular preference, the narrowing portion) of a second conductor part (and to do so even in a neutral position if required, under a pre-loading).

An advantageous and particularly inexpensive possible way of manufacturing a conductor part of this kind, having resilient tongues, may be produced by bending round a blank cut to shape, i.e., a planar component in which the resilient tongues are already formed, into a tube of any desired cross-section but in particular of a circular one.

What is meant by a "neutral position" is a relative position of the two conductor parts in which a relative movement can be achieved only by applying external forces.

This neutral position which is characterized by forces in a state of equilibrium may preferably be achieved by providing between the conductor parts a stop which limits a relative movement due to the radial elastic deformation.

For good contact to be made between the two components, a contact-making surface of relatively large area should in each case be available on the connecting member. This relatively large contact-making surface may be created by appropriate shaping and in particular by making the conductor parts of relatively large cross-section at those ends of the conductor parts which are intended to make contact with the respective components. In the case of the conductor part which is preferably formed by bending round a blank cut to shape, provision may be made for it to be connected to an annular (the annulus being of any desired form but preferably circular) adapter member which creates the contact-making surface of relatively large area. By this means it is possible to dispense with the need for the blank cut to shape to be folded over at the ends if, as is possible, its thickness is not sufficiently great to create a contact-making surface of large enough area. The adapter member may also be so designed (e.g., may be L-shaped in cross-section) that it surrounds (a portion of) the conductor part and holds the latter in its tubular shape. Any connection of the butt joint by welding, brazing, soldering or adhesive bonding, or the like, can then be dispensed with if necessary.

In a preferred embodiment of connecting member according to the invention, provision is made for the conductor to be intended as the outer conductor of a co-axial connecting member, which outer conductor thus surrounds a further conductor (a center conductor). This center conductor may preferably take the known form of a spring-loaded contact pin and may thus comprise a sleeve, one or two plungers which are partly guided within the sleeve, and one or more spring members which urge the plunger/plungers towards their extended position. Spring-loaded contact pins of this kind are notable for having good transmission characteristics particularly for radio-frequency signals and also for insensitivity to tolerances on the positions of the components to be connected together. Tolerances on the distance between the two components are compensated for by the possibility of a displacement of the plunger(s) in the sleeve. The spring member(s) ensures/ensure in this case that there is an adequate force pressing the plunger(s) against the particular adjoining component(s).

An insulating member is preferably arranged between the outer conductor and the center conductor. To give a unit which can be handled satisfactorily, this insulating member may preferably be solidly connected to the center conductor and to at least a portion of the outer conductor. The possibility also exists in this case of the insulating member being solidly connected to the whole of the outer conductor, provided it has a relatively low modulus of elasticity and thus does not hamper the relative movement of the two parts of the outer conductor for which provision is made in accordance with the invention, or does so to only an insignificant degree.

The connecting member shown in FIGS. 1 to 5 is used to connect two printed circuit boards together with an electrically conductive connection. The connecting member comprises a center conductor 1, an outer conductor 2, and an insulating member 3 which is arranged between the center conductor 1 and outer conductor 2. The center conductor 1 is in the form of a spring-loaded contact pin, i.e., it comprises a sleeve 4 and two plungers 5 which are partly guided within the sleeve to be movable. Arranged inside the sleeve 4 is a coil spring (not shown) which is supported between the two plungers 5 and which urges them into their respective extended positions.

The outer conductor 2 comprises a first conductor part 6 having a tubular shell, of circular cross-section, which is formed by a plurality of resilient tongues 7. The fixed ends of the resilient tongues merge into a base portion 8 of the first conductor part 6. The base portion 8 itself is held in an annular adapter member 9 whose wall is of an L-shaped cross-section. A first limb of the L-shaped wall makes contact with the outside of the base portion 8 and fixes the latter in place in the radial direction. The inner side of the second limb of the L-shaped wall makes contact with the end-face of the base portion 8 and fixes the said base portion 8 in place in the axial direction (which corresponds to the direction of connection). The outside of the said second limb acts as a contact-making surface 16 to make contact with a first printed circuit board. The connection between the base portion 8 of the first conductor part 6 and the latter's adapter member 9 is of a durable form due to its being a press-fit.

The outer conductor 2 also comprises a second conductor part 10 which is likewise of a tubular form (of circular cross-section), and which is of almost the same length as the insulating member 3, and a portion of the said second conductor part which forms a solid shell is solidly connected (e.g. adhesive bonded) to the insulating member 3. At its end portion which is arranged against the base portion 8 of the first conductor part 6, the second conductor part 10 is slotted more than once (four times in fact) in the longitudinal direction, and thus likewise forms resilient tongues 11 although the resilient stiffness of these tongues is greater than that of the resilient tongues 7 of the first conductor part 6. The purpose of the resilient tongues 11 of the second conductor part 10 is to ensure that the relevant end of the second conductor part 10 bears securely against the inside of the base portion 8 or the first conductor part 6. To enable the resilient tongues 11 to deflect inwards, the portion concerned of the insulating member 3 is formed to be of slightly smaller diameter.

At the opposite end from the base portion 8, the second conductor part 10 forms on its outside a narrowing and in fact conical portion 12. This conical portion 12 merges into an annular projection 13 which acts as a stop for the (free) end portions 14 of an arcuate shape of the resilient tongues 7 of the first conductor part 6. When the connecting member is in the neutral position shown in FIG. 1, the arcuate end portions 14 of the resilient tongues 7 are thus situated in the transition, of a complementary shape, between the conical portion 12 of the second conductor part 10 and its annular projection 13. In this position, it is only possible for the two telescopically inter-inserted conductor parts 6, 10 to be pulled apart by the application of considerable force. Sliding of the conductor parts 6, 10 together on the other hand is possible simply by the exertion of a comparatively low thrust force, the two conductor parts 6, 10 producing an opposing force which is the result of the radial elastic deformation (deflection) of the resilient tongues 7 of the first conductor part 6. This radial deflection of the resilient tongues 7 is a consequence of the relative displacement by sliding of the arcuate end portions 14 of the resilient tongues 7 of the first conductor part 6 on the conical portion 12 of the second conductor part 10.

The end-face of the end portion of the second conductor part 10, which end portion has the conical portion 12, likewise forms a contact-making surface 15, which serves to make contact with a second printed circuit board.

Because the center conductor 1 is solidly connected to the insulating member 3 and the insulating member 3 to the second conductor part 10, and because the connection between the second conductor part 10 and the first conductor part 6 is displaceable only within limits, the connecting member constitutes a unit able to be handled satisfactorily whose components are connected together in a sufficiently secure way.

For two printed circuit boards to be connected electrically by means of the connecting member according to the invention for the transmission of radio-frequency signals, the connecting member is first connected solidly to a first printed circuit board 17. In the example shown in FIGS. 2 to 5, this is done by means of the contacting-making surface 15 of the outer conductor 2, which contacting-making surface 15 is formed by the second conductor part 10. The corresponding (bottom) plunger 5 of the center conductor 1 is displaced into the sleeve 4 in this case sufficiently far for its tip to be substantially on a level with the contact-making surface 15 of the second conductor part 10. By generating a corresponding opposing force, the preloading by the coil spring which is thereby increased ensures that the plunger makes secure contact with the associated point of contact on the printed circuit board 17.

Figure 3:
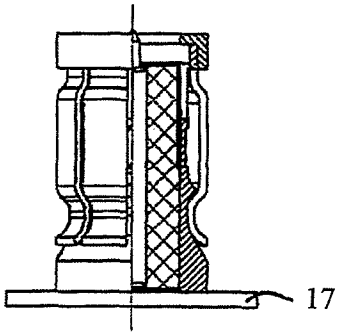
Figure 2:
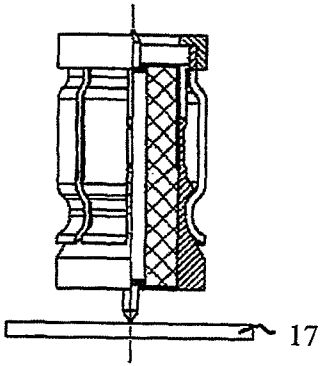

The second printed circuit board 18 is then fitted, and thus presses against that end of the outer conductor which is formed by the first conductor part with a defined applying force (see FIG. 3). This applying force may vary due to the tolerances on the positions of the two printed circuit boards 17, 18. The pressing of the second printed circuit board 18 against the connecting member causes, on the one hand, a displacement of the corresponding (top) plunger 5 of the center conductor 1 in opposition to the force from the coil spring. The preloading from the spring which is further increased in this way ensures that the plunger 5 makes secure contact with the corresponding point of contact on the printed circuit board 18.

Figure 5:
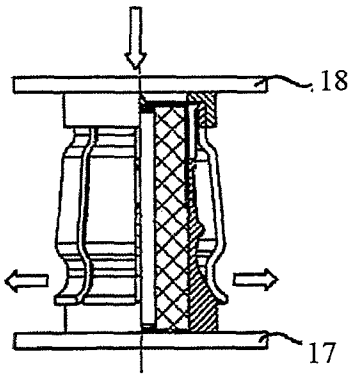
FIGS. 2 to 5 show different stages in the connection of the connecting member shown in FIG. 1 to two printed circuit boards.
Figure 4:
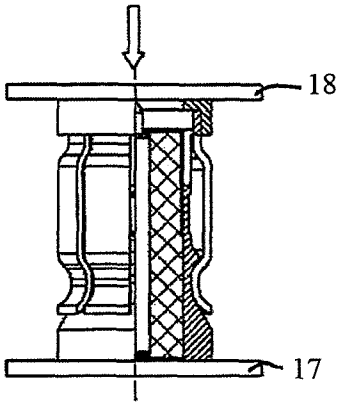

The fact of the top printed circuit board 18 being pressed against them also ensures that there is at least a small relative displacement of the two conductor parts 6, 10 in the axial direction or in other words the direction of connection (see FIG. 5). This is the result simply of the overall length of the outer conductor 2 in the neutral position being of a size such that this length is slightly greater than the maximum distance between the two printed circuit boards 17, 18 which is permitted by the tolerances. The relative displacement of the conductor parts 6, 10 results in the radial elastic deflection of the resilient tongues 7 of the first conductor part 6 which has already been described. This produces a restoring force which ensures that there is an adequate contact-making pressure at the points of contact between the connecting member and the printed circuit boards 17, 18. At the same time, the relative axial mobility of the conductor parts 6, 10 makes it possible for tolerances on the positions of the two printed circuit boards 17, 18 to be compensated for, it being possible for tolerances not only on the distance of the two printed circuit boards 17, 18 from one another but also, within limits, on a non-parallel state thereof to be compensated for, because, by virtue of the contact made between the first conductor part 6 and second conductor part 10 solely via the resilient tongues 7, 11, there is (limited) relative mobility even in the radial direction.

While the present invention has been particularly described, in conjunction with a specific preferred embodiment, it is evident that many alternatives, modifications and variations will be apparent to those skilled in the art in light of the foregoing description. It is therefore contemplated that the appended claims will embrace any such alternatives, modifications and variations as falling within the true scope and spirit of the present invention.

Thus, having described the invention, what is claimed is:

1. A connecting member for the electrically conductive connection of two components, including a conductor, the conductor comprising at least a first conductor part and a second conductor part, wherein the second conductor part has on its outside a tapered portion, wherein the tapered portion merges into an annular projection which acts as a stop for resilient tongues of the first conductor part, wherein in a neutral position the resilient tongues are situated in a transition, of a complementary tapered shape, between the tapered portion of the second conductor part and its annular projection, wherein the first conductor part and the second conductor part are configured to be movable relative to one another in the direction of connection, a relative movement only being possible by an application of external forces when the two conductor parts are in the neutral position, wherein the relative movement of the conductor parts results in a radial elastic deformation of at least one of the conductor parts, caused by the tapered portion, a sliding together of the conductor parts being possible in the neutral position by the exertion of a low thrust force to compensate for tolerances on the positions of the two components to be connected, and wherein the stop limits the relative movement of the conductor parts, thus only being possible for the conductor parts to be pulled apart while in the neutral position by the application of a considerable force, wherein said low thrust force is lower than said considerable force.

2. The connecting member of claim 1, wherein the first conductor part comprises the resilient tongues which bear against a surface of the second conductor part.

3. The connecting member of claim 2, wherein the first conductor part is produced by bending round a blank cut to shape into a tube.

4. The connecting member of claim 2, wherein a free end of the first conductor part is connected to an annular adapter member which creates at one axial end of the connecting member a contact-making surface to make contact with a first component, and a free end of the second conductor part creates at the other axial end of the connecting member a contact-making surface to make contact with a second component.

5. The connecting member of claim 4, wherein the annular adapter member is of an L-shaped form in cross-section.

6. The connecting member of claim 1, wherein a free end of the first conductor part is connected to an annular adapter member which creates at one axial end of the connecting member a contact-making surface to make contact with a first component, and a free end of the second conductor part creates at the other axial end of the connecting member a contact-making surface to make contact with a second component.

7. The connecting member of claim 6, wherein the annular adapter member is of an L-shaped form in cross-section.

8. The connecting member of claim 1, wherein the conductor surrounds a center conductor as an outer conductor.

9. The connecting member of claim 8, wherein the center conductor is in the form of a spring-loaded contact pin.

10. The connecting member of claim 9, including an insulating member arranged between the outer conductor and the center conductor.

11. The connecting member of claim 10, wherein the insulating member is solidly connected to the center conductor and to at least a portion of one of the conductor parts.

12. The connecting member of claim 8, including an insulating member arranged between the outer conductor and the center conductor.

13. The connecting member of claim 12, wherein the insulating member is solidly connected to the center conductor and to at least a portion of one of the conductor parts.

* * * * *